US009449458B2

(12) United States Patent
Panzarella et al.

(10) Patent No.: US 9,449,458 B2
(45) Date of Patent: Sep. 20, 2016

(54) POWER CYCLING OF GAMING MACHINE

(71) Applicants: Russell C. Panzarella, Arlington Heights, IL (US); John Burica, Palos Heights, IL (US); Scot Salzman, Buffalo Grove, IL (US)

(72) Inventors: Russell C. Panzarella, Arlington Heights, IL (US); John Burica, Palos Heights, IL (US); Scot Salzman, Buffalo Grove, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 263 days.

(21) Appl. No.: 14/246,215

(22) Filed: Apr. 7, 2014

(65) Prior Publication Data

US 2015/0287273 A1 Oct. 8, 2015

(51) Int. Cl.
*G07F 17/32* (2006.01)

(52) U.S. Cl.
CPC ..... *G07F 17/3223* (2013.01)

(58) Field of Classification Search
None
See application file for complete search history.

(56) References Cited

U.S. PATENT DOCUMENTS

| | | | | |
|---|---|---|---|---|
| 5,795,229 | A | 8/1998 | Johnson | 463/47 |
| 6,773,348 | B2 | 8/2004 | Stockdale | 463/29 |
| 7,366,922 | B2 | 4/2008 | Takeda et al. | 713/300 |
| 8,083,594 | B2 | 12/2011 | Schreiber et al. | 463/46 |
| 8,262,464 | B2 | 9/2012 | Canterbury et al. | 463/24 |
| 8,303,398 | B2 | 11/2012 | Canterbury | 463/24 |
| 8,460,091 | B2 | 6/2013 | Wells et al. | 463/43 |
| 2009/0137312 | A1 | 5/2009 | Walker et al. | 463/25 |
| 2009/0253495 | A1* | 10/2009 | Loose | G07F 17/3202 463/25 |
| 2010/0062833 | A1 | 3/2010 | Mattice et al. | 463/24 |
| 2010/0285866 | A1 | 11/2010 | Bleich et al. | 463/24 |
| 2011/0195792 | A1* | 8/2011 | Wells | G07F 9/026 463/43 |
| 2012/0108338 | A1* | 5/2012 | Wells | G07F 9/026 463/37 |
| 2012/0129371 | A1* | 5/2012 | Spence, Jr. | G07F 17/32 439/188 |
| 2013/0191624 | A1 | 7/2013 | Jarmay | 713/2 |
| 2013/0252712 | A1 | 9/2013 | Wells et al. | 463/24 |
| 2014/0087849 | A1* | 3/2014 | Page | G07F 17/3239 463/25 |

FOREIGN PATENT DOCUMENTS

| | | | |
|---|---|---|---|
| WO | WO2008/018874 A1 | 2/2008 | A63F 13/00 |

* cited by examiner

*Primary Examiner* — Jay Liddle
(74) *Attorney, Agent, or Firm* — Marc D. Thompson

(57) ABSTRACT

The present invention relates to enabling an operating system software to selectively power cycle one or more components of a wagering gaming system comprising a central processing unit board having one or more central processing units, and one or more central processing unit components. The invention uses a memory comprising a dedicated power cycle control register, a power controller, and digital logic configured to initiate a power cycle of the one or more components of the wagering gaming machine when the operating system writes a predetermined value to the power cycle control register. Upon recognizing the predetermined value to a dedicated power cycle control register used solely for power cycling procedures, digital logic is initiated to terminate voltage supplied to the one or more components of the wagering gaming machine and restore power to the one or more components of the wagering gaming machine, effectively "cold booting" the selected one or more components of the wagering gaming machine main system board(s) without disrupting voltage supplied to the entirety of other components, including peripheral devices of the wagering gaming system.

20 Claims, 6 Drawing Sheets

POWER CYCLING OF GAMING MACHINE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to wagering game apparatus and methods enabling wagering game machine operating system software to enable digital logic to selectively power cycle central processing unit board components of the gaming apparatus, without interrupting, disrupting power, or otherwise altering the state of connected peripheral devices and other components of the wagering game system.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player. There is also a continuing need for gaming machines to become more efficient and improve the time it takes to become fully operational and operate without further problems in response to errors and/or failure of one or more components.

Power cycling is the act of turning a piece of electronic equipment off (terminating power supplied to the equipment) and then back on again (returning power supplied to the equipment). Reasons for power cycling may include requiring an electronic device to reinitialize configuration to a given default or expected state, recover from an unresponsive state of one or more components of the system (e.g., a non-responsive component or memory device, or a system hang or crash), or reboot after a memory alteration, software installation procedure, or other configuration change. When a central processing unit or central processing unit baseboard of a gaming machine requires a "cold boot" (i.e., a total central processing unit system reset caused by removal of power to the central processing unit and connected board), it is typically necessary to power down the entire gaming machine cabinet, either by manually using a main power switch controlling power which enters the gaming machine, physically pulling the plug from the outlet, or interacting in some other physical way with the gaming machine to effect a power down and subsequent repowering. For these reasons, power cycling is often performed manually, requiring physical interaction with the equipment by a technician or other human being. These methods have undesirable side effects of requiring physical interaction with the equipment. Additionally, severing all power to the gaming machine cabinet and powering down components (and peripherals) which will be unnecessarily rebooted and reinitialized increases time and complication to an otherwise simplified power cycling procedure.

Therefore, there is need in the art for a gaming machine to selectively power cycle the central processing unit (and the entire central processing unit baseboard) of the gaming machine without disrupting or resetting other system components and peripherals of the controlled gaming machine, initiated by instruction of software (i.e., the operating system), and independently managing the power cycling process by hardware once the power cycling has been initiated.

There is also need in the art for a gaming machine to selectively power cycle specific components of the central processing unit baseboard of the gaming machine without physical manipulation of switches or other components on the gaming machine. One embodiment of the invention obviates the need for a technician to turn off (and turn back on) the gaming machine, unplug (and re-plug) the gaming machine, otherwise physically interact with, or be in proximity to the gaming machine. The ability to initiate and execute power cycling of the gaming machine central processing unit baseboard, central processing units, and/or components coupled to baseboard voltage controller(s) in highly desirable.

SUMMARY OF THE INVENTION

One embodiment of the invention describes a wagering game machine including a central processing unit board. The central processing unit board includes one or more central processing unit board components which include at least one central processing unit. At least one central processing unit is configured to conduct a wagering game, receive wagers, and randomly determine outcomes of the wagering game. The wagering game machine further includes a power controller coupled to the one or more central processing board components, providing the one or more central processing board components with voltage for operation. The wagering game machine further includes a power cycle control register dedicated for initiating a power cycle control function when a predetermined value is stored within. The wagering game machine further includes a power cycle circuit coupled to the power cycle control register and the power controller such that, in response to detection of the predetermined value in the power cycle control register, the power cycle circuit performs the power cycle control function by terminating voltage supplied by the power controller and then restoring the voltage supplied by the power controller.

Another embodiment of the invention describes a method for selectively initiating a power cycle control function of one or more central processing unit components coupled to a power controller of a board of a wagering gaming machine. The method involves writing a value to a power cycle control register dedicated for initiating the power cycle control function of the one or more central processing unit components when a predetermined value is stored within. Upon detection that the predetermined value is stored within the power cycle control register, the power controller performs the power cycle control function by terminating voltage supplied by the power controller and then restoring the voltage supplied by the power controller.

In another embodiment of the invention, a method for selectively initiating a power cycle control function of powered components coupled to a board of a wagering gaming machine is described. The method involves writing a value to a power cycle control register dedicated for initiating the power cycle control function of the powered components coupled to the board of the wagering gaming machine when a predetermined value is stored within. Upon detection that the predetermined value is stored within the power cycle control register, the power cycle control function is performed by terminating voltage supplied by a power controller to the powered components coupled to the board of the wagering game machine and then restoring the voltage supplied by the power controller to the powered components coupled to the board of the wagering game machine.

According to yet another aspect of the invention, computer readable storage media is encoded with instructions for directing a gaming system to perform the above methods.

According to still another aspect of the invention, the above gaming system is incorporated into a single, free-standing gaming terminal.

Additional aspects of the invention will be apparent to those of ordinary skill in the art in view of the detailed description of various embodiments, which is made with reference to the drawings, a brief description of which is provided below.

Figure 1:
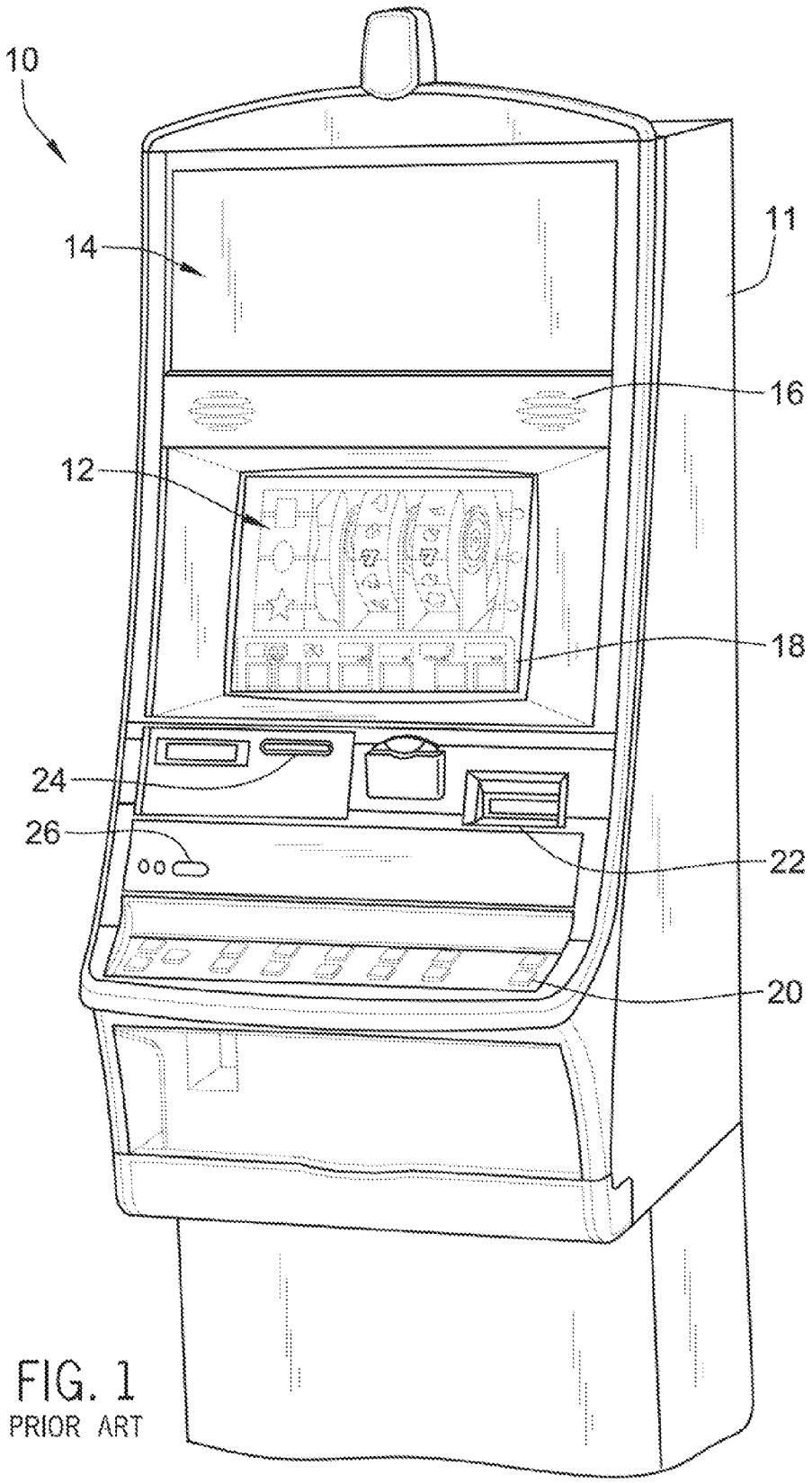
FIG. 1 PRIOR ART
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those used in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in conducting wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a cabinet 11 that may house various input devices, output devices, and input/output devices. By way of example, the gaming machine 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

Input devices, such as the touch screen 18, buttons 20, a mouse, a joystick, a gesture-sensing device, a voice-recognition device, and a virtual-input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a game-logic circuitry for processing. The electronic data signals are selected from a group consisting essentially of an electrical current, an electrical voltage, an electrical charge, an optical signal, an optical element, a magnetic signal, and a magnetic element.

Figure 2:
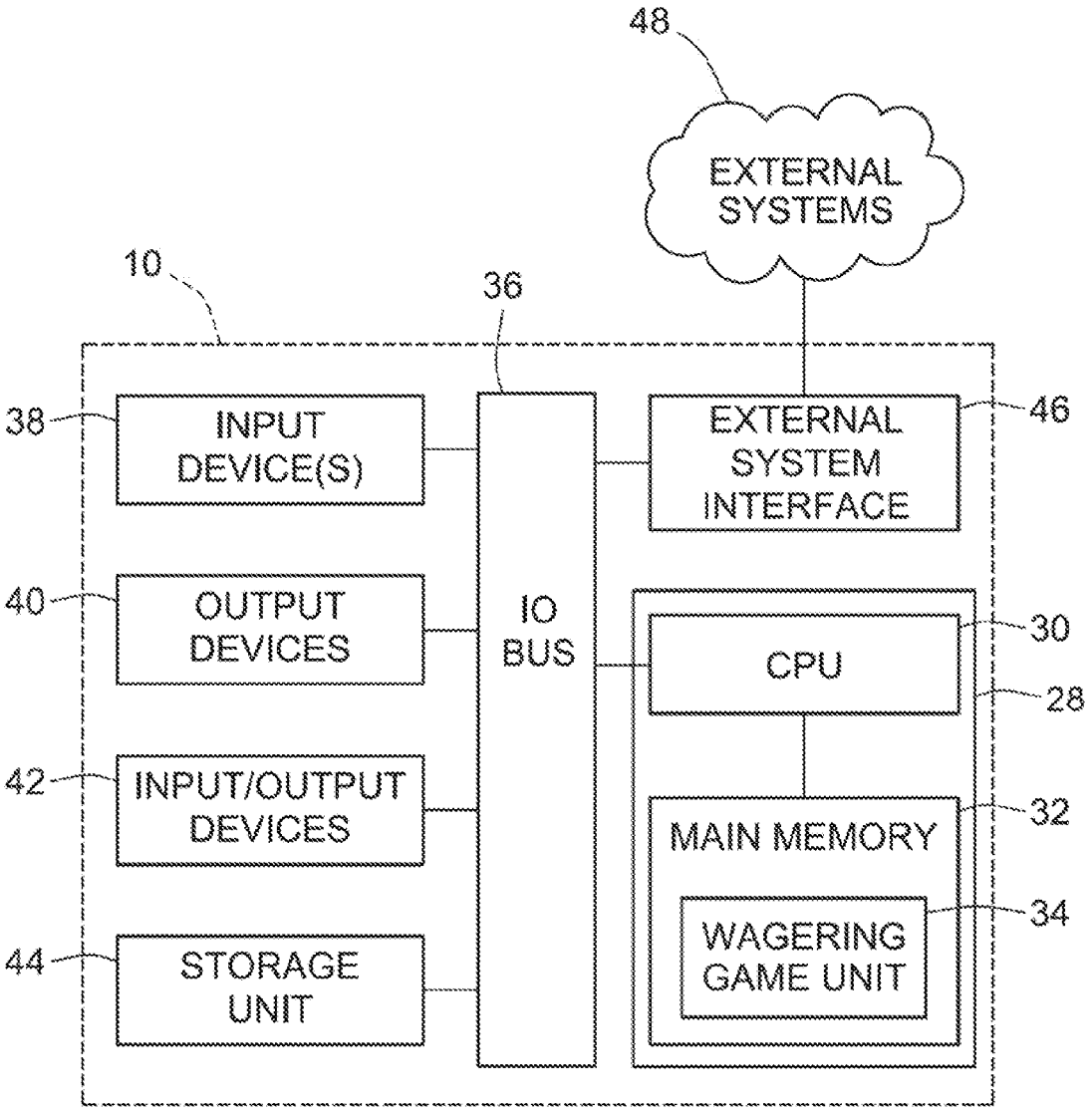
FIG. 2 PRIOR ART
FIG. 2 is a schematic view of a gaming system according to an embodiment of the present invention.

Turning now to FIG. 2, there is shown a block diagram of the gaming-machine architecture. The gaming machine 10 includes game-logic circuitry 28 having a central processing unit (CPU) 30 connected to a main memory 32. The CPU 30 may include any suitable processor(s), such as those made by Intel and AMD. By way of example, the CPU 30 may include a plurality of microprocessors including a master processor, a slave processor, and a secondary or parallel processor. Game-logic circuitry 28, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 28, and more specifically the CPU 30, comprises one or more controllers or processors and such one or more controllers or processors need not be disposed proximal to one another and may be located in different devices or in different locations. The game-logic circuitry 28, and more specifically the main memory 32, comprises one or more memory devices which need not be disposed proximal to one another and may be located in different devices or in different locations. The game-logic circuitry 28 is operable to execute all of the various gaming methods and other processes disclosed herein. The main memory 32 includes a wagering-game unit 34. In one embodiment, the wagering-game unit 34 may cause wagering games to be presented, such as video poker, video black jack, video slots, video lottery, etc., in whole or part.

The game-logic circuitry 28 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to a storage unit 44 and an external-system interface 46, which may be connected to external system(s) 48 (e.g., wagering-game networks).

The external system 48 includes, in various aspects, a gaming network, other gaming machines or terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external-system interface 46 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 48 such that the gaming machine 10 operates as a thin, thick, or intermediate client. The game-logic circuitry 28—whether located within ("thick client"), external to ("thin client"), or distributed both within and external to ("intermediate client") the gaming machine 10—is utilized to provide a wagering game on the gaming machine 10. In general, the main memory 32 (comprising one or more memory devices) stores programming for an RNG, game-outcome logic, and game assets (e.g., art, sound, etc.). When a wagering-game instance is executed, the CPU 30 (comprising one or more processors or controllers) executes the RNG programming to generate one or more pseudo-random numbers. The pseudo-random numbers are utilized by the CPU 30 when executing the game-outcome logic to determine a resultant outcome for that instance of the wagering game. The resultant outcome is then presented to a player of the gaming machine 10 by accessing the associated game assets, required for the resultant outcome, from the main memory 32. The CPU 30 causes the game assets to be presented to the player as outputs from the gaming machine 10 (e.g., audio and video presentations).

The gaming machine 10 may include additional peripheral devices or more than one of each component shown in FIG. 2. Any component of the gaming-machine architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
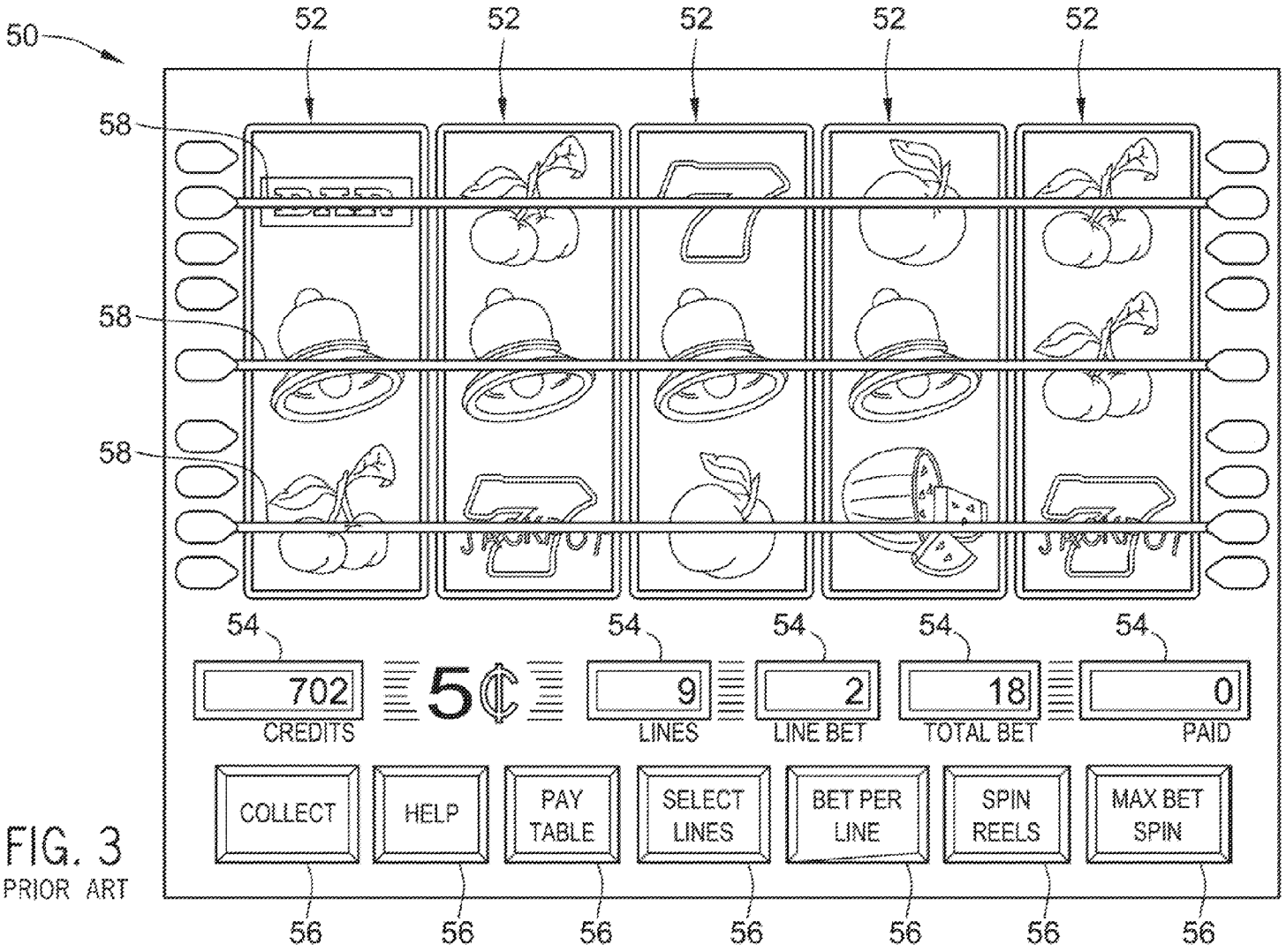
FIG. 3 PRIOR ART
FIG. 3 is an image of an exemplary basic-game screen of a wagering game displayed on a gaming machine, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The game-logic circuitry 28 operates to execute a wagering-game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 12 or secondary display 14) through the display of information such as, but not limited to, text, graphics, static images, moving images, etc., or any combination thereof. In accord with the method of conducting the wagering game, the game-logic circuitry 28 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 28 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 30 causes the recording of a digital representation of the wager in one or more storage media (e.g., storage unit 44), the CPU 30, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU 30 (e.g., the wager in the present example). As another example, the CPU 30 further, in accord with the execution of the stored instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 28 to determine the outcome of the wagering-game instance. In at least some aspects, the game-logic circuitry is configured to determine an outcome of the wagering-game instance at least partially in response to the random parameter.

Figure 4:
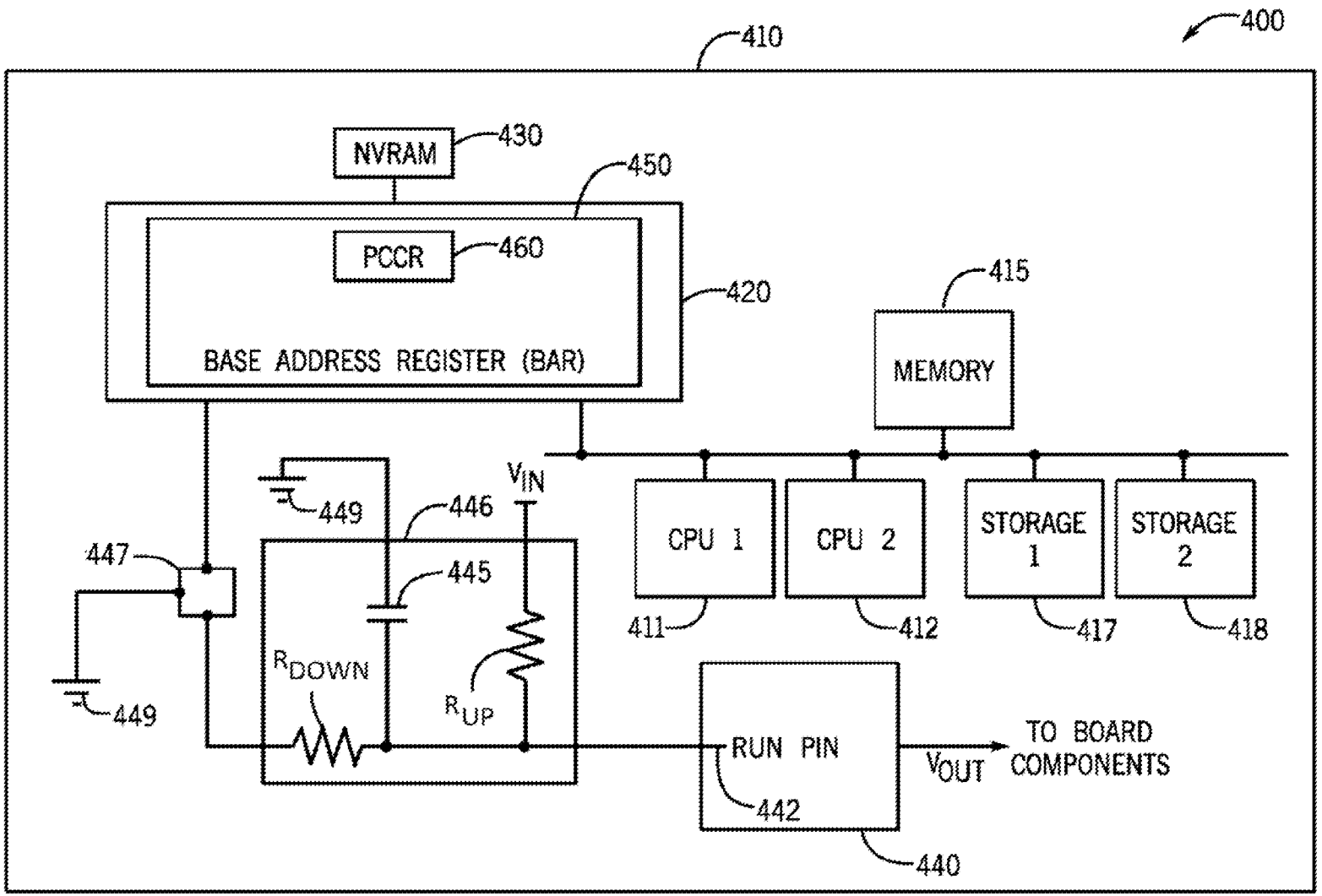
FIG. 4 is a schematic view of a gaming system having a register which controls selective power cycling of one or more central processing unit components according to an embodiment of the present invention.

Referring to FIG. 4, a schematic is shown of a gaming system 400 in accordance with one embodiment of the invention. In some embodiments, FIG. 4 shares some similarity and overlap with the generalized gaming machine shown in FIG. 2, in that in one embodiment, baseboard 410 is equivalent to game-logic circuitry 28. In other embodiments, baseboard 410 comprises various other components described in relation to FIG. 2. It is noted that any specific configuration of components of gaming machine 10 and baseboard 410 which remains compatible with the operations described may be used and does not depart from the spirit and scope of the present invention.

An entire power-off to power-on process is called a power cycle. Since the combination of components which are coupled to or directly mounted to baseboard 410 is highly variable, there is an important need for a gaming machine to be configured to selectively power cycle the central processing unit baseboard and/or central processing unit baseboard component(s) of the gaming machine without physical manipulation of the gaming machine itself in the event that a specific component or baseboard reset is specifically required. This may be due to a reported error condition, or as a portion of a larger logical operation, such as replacing gaming or operating system specific programmatic instructions with updated drivers which require a complete reinstallation (or "cold boot") of the baseboard and associated component(s).

In one embodiment, gaming system 400 includes a central processing unit baseboard 410, which includes one or more central processing units 411, 412, memory 415, a digital logic module 420, a non-volatile random access memory (NVRAM) module 430, and voltage controller 440. Memory 415 is utilized by one or more of the central processing units 411, 412 to store executable instructions, including but not limited to an operating system, and data. Persistent storage unit 417 and 418 (for example, solid state drive, hard disk drive, flash memory module, or compact flash module) act as data storage for various components on and off the central processing unit baseboard 410, including providing executable programmatic functionality to perform game logic and interpret/process input from peripherals like buttons and sensors.

Digital logic module 420 uses NVRAM 430 to retrieve and store other persistent data, like maintaining game states, important or recorded peripheral transactions, system event logging, etc. During a power cycle, while baseboard 410 power is deactivated and re-activated (potentially in addition to the components of baseboard 410), power to NVRAM 430 is typically not cycled. In one embodiment, NVRAM 430 is battery backed up and memory contents are preserved across power cycles to maintain persistent data for a number of different reasons, both operational and regulatory.

Digital logic module 420 contains a base address register (BAR) 450. In one embodiment of the invention, BAR 450 is instantiated by the physically configured logic and components of the digital logic module 420. In another embodiment, BAR 450 is part of an independent memory space. BAR 450 comprises a power cycling control register (PCCR) 460. Digital logic module 420 uses BAR 450 to report and access various system information using various subsections of BAR 450, including PCCR 460 which specifically dictates that the operating system is calling for a power cycle of baseboard 410. In one embodiment, PCCR 460 is purely dedicated to indicating power cycling of the baseboard 410, and is utilized solely for this purpose; no other meaningful information is stored in or read from PCCR 460. In one embodiment, software enabled by the operating system writes a predetermined value to a specific address offset in BAR 450 corresponding to the PCCR 460. In other embodiments, the operating system itself exclusively writes to sections of BAR 450, including PCCR 460.

When the operating system writes this predetermined value to PCCR 460, digital logic module 420 executes instructions which selectively powers down some portion of (or the entirety of) central processing unit baseboard 410, specifically controlled by one or more power controllers 440. In one embodiment, controller 440 supplies each and every component of baseboard 410 with voltage for operation, and digital logic module 420 executes instructions which power cycles controller 440 which causes the entire central processing unit baseboard 410 to lose and regain power (power cycling the whole of central processing unit baseboard 410).

In other embodiments, there are multiple controllers 440 which individually control various corresponding components of baseboard 410. For example, in one embodiment, multiple distinct power controllers 440 are implemented to individually supply power to various sets of central processing unit components. This could include a single dedicated power controller 440 for hard disk and solid state non-volatile memory drives, and/or distinct power controllers for each particular device. In another embodiment, a power controller 440 may provide voltage for all memory devices coupled to the baseboard (e.g., 417, 418, 420, 430, etc.), and another distinct power controller (not shown) provides voltage to enable central processing units 411 and 412 to operate.

In one embodiment, controller 440 operates to deliver voltage to associated baseboard components when voltage delivered to RUN pin 442 exceeds a predetermined level, and an electronic component 447 (for example, a field effect transistor (FET)) is implemented to selectively shunt all voltage delivered to the RUN pin 442 to ground 449. The state of electronic component 447 is controlled by signaling from digital logic module 420. This causes voltage to RUN pin 442 to fall below the predetermined level, which interrupts voltage to the various components powered by controller 440. In response to restoring voltage to RUN pin 442 which exceeds this predetermined level, voltage to the various components powered by controller 440 begin to receive voltage once again.

In another embodiment, controller 440 is configured with some other mechanism, which when activated (for example, with voltage from $V_{IN}$), simply deactivates controller 440, and causes voltage supply to stop to various components of baseboard 410. Activation may be performed by digital logic module 420, one of the processors 411/412, or by another dedicated processor or piece of circuitry (not shown).

In one embodiment, a resistor-capacitor (RC) circuit 446 is placed between electronic component 447 and controller 440, and is additionally coupled to voltage source $V_{IN}$ and ground 449. RC circuit 446 includes capacitor 445 positioned between ground 449 and RUN pin 442. RC circuit 446 causes associated delays to occur during voltage changes to RUN pin 442 of controller 440 during different phases of the power cycling function. That is, in one embodiment, electric charge stored within capacitor 445 is drained when voltage to RUN pin 442 is grounded or rerouted, and electric charge is actively stored within capacitor 445 when voltage provided to RUN pin 442 is high, and the draining and charging of capacitor 445 takes a specific, predetermined amount of time. The duration of these delays are generally dependent upon the electric capacity of capacitor 445 and the resistance of the resistors $R_{UP}$ and $R_{DOWN}$.

In another embodiment, RC circuit 446 is placed having controller 440 $V_{OUT}$ as incoming voltage for RC circuit 446; that is, voltage supplied from controller 440 is used to supply voltage to RC circuit 446 which then supplies voltage to additional controllers or components directly. This allows logic module 420 to selectively provide power control for any component or set of components coupled to a given baseboard.

When electronic component 447 is configured to block power being routed to ground 449 (by logic module 420 asserting no or low voltage to electronic component 447), $V_{IN}$ actively supplies voltage to RUN pin 442 via $R_{UP}$; because voltage is supplied to RUN pin 442, capacitor 445 begins to store electric charge. As discussed above, the time spent for complete charging of capacitor 445 delays the delivery of voltage to RUN pin 442 a determinable amount, in direct accordance with the electric charge capacity of capacitor 445 and resistance of the resistor $R_{UP}$. This, in turn, also delays the power-up phase of the power cycling of baseboard 410 and baseboard components due to the time it takes to fully charge capacitor 445, flowing through $R_{UP}$ when high voltage is applied to RUN pin 442. In one embodiment, capacitor 445 and resistor $R_{UP}$ are specifically selected to delay approximately 1.5 seconds, providing a suitable time delay for board components to reach equilibrium and return to a default state prior to having voltage supplied for initialization and resumed operation.

When electronic component 447 is configured to route power to ground 449 (activated by logic module 420 asserting "high" voltage to electronic component 447), voltage supplied by $V_{IN}$ passes through $R_{DOWN}$ instead of passing through $R_{UP}$. This is due to $R_{DOWN}$ being much less resistant to electric flow (i.e., having a lower resistance) than $R_{UP}$; this results in minimal time delay for capacitor 445 to drain when voltage is not supplied, and a much higher delay for capacitor 445 to charge when voltage is supplied. This serves to provide a suitable time period delay for board components to fully reset and properly reinitialize when voltage is restored to controller 440, and to minimize the time it takes to be powered down.

It is further noted that any duration of time and associated use of an accommodating resistance-capacitor circuit to cause delay during powering up and powering down does not depart from the spirit and scope of the present invention. Further, any of the particular configurations presented should not be considered to be specifically limiting; any corresponding structure which can result in the described functionality does not depart from the spirit and scope of the present invention.

In one embodiment of the invention, the digital logic module 420 comprises a field-programmable gate array (FPGA) which may be reconfigured as necessary to provide additional or enhanced functionality. In other embodiments of the invention, digital logical module 420 may be realized by an application-specific instruction-set processor (ASIP), an application specific integrated circuit (ASIC), programmable read-only memory (PROM) modules, programmable logic device (PLD) modules, erasable programmable logic device (EPLD) modules, other integrated circuit (IC) modules, even erasable programmable read-only memory (EPROM) modules, electrically erasable programmable read-only memory (EEPROM) modules, random access memory (RAM) modules, and a variety of other configurations which may or may not include further (central) processing unit(s) to execute instructions stored within. In some of these embodiments, the dedicated power cycling control register 460 is contained within integrated circuitry of digital logic module 420. In other embodiments, PCCR 460 is a dedicated hardware register allowing the isolated reading and writing of the contents of PCCR 460 simultaneously. However, PCCR 460 can take on a number of varying forms without departing from the spirit and scope of the invention, including an offset address of a larger memory space or a uniquely addressable standalone physical memory module. It is noted these various configuration or operating specifics do not depart from the spirit and scope of the present invention and should not be held as specifically limiting.

Figure 5:
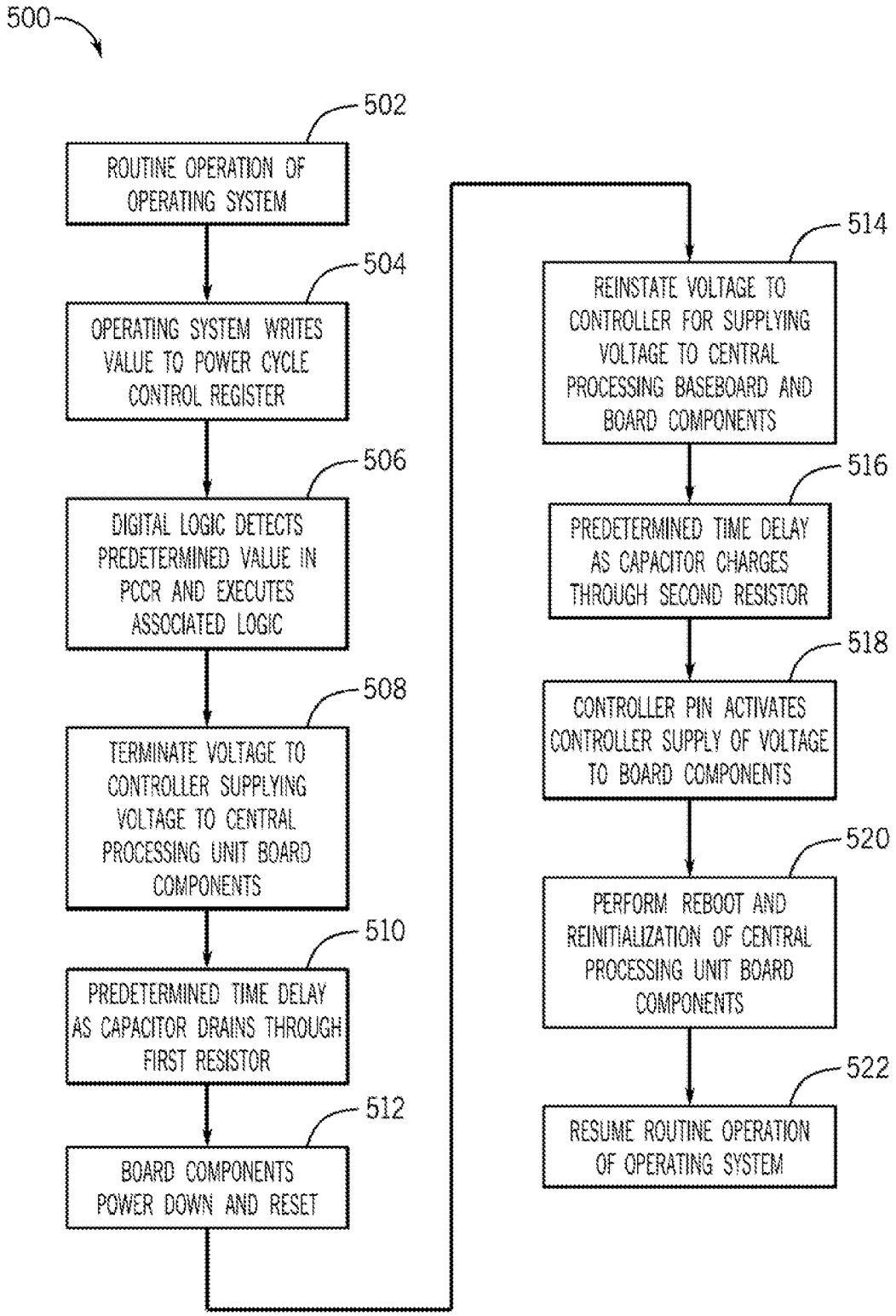
FIG. 5 is a flowchart for an algorithm for power cycling a central processing unit board and a set of one or more central processing unit board components coupled to the board according to an embodiment of the present invention.

According to one embodiment, FIG. 5 shows a flowchart for an algorithm for power cycling a central processing unit baseboard having one or more central processing unit modules. Power cycling process 500 begins during routine operation of the operating system (step 502). The operating system executes on one or more central processing units of a gaming machine (for example, gaming machine 400), and generally controls access and operation of the various hardware resources of the gaming machine.

In step 504, the operating system writes a predetermined value to a dedicated power cycle control register which is dedicated for this power cycling function. This may be a direct result of the operating system or on behalf of a software process executing in the operating system. This predetermined value is specifically intended to cause the gaming machine to power cycle the central processing system board and/or one or more of the central processing unit component(s) of the gaming machine, which may or may not include one or more of the central processing unit(s) of the gaming machine. A predetermined value in the dedicated register is used to obviate the possibility that an aberration of digital storage occurs causing an inadvertent power cycling process, or a mistaken power cycling request is initiated. The writing of this predetermined value may be due to arbitrary detection of an error which requires power cycling to clear the error, as part of a larger process of software or module installation, memory/cache clearing, and/or driver installation, or as a result of a direct command issued by an authorized administrator either in proximity or remotely located to the gaming machine. Any or all of these conditions or triggers are within the scope and spirit of the invention, and are only presented as examples for explaining operation of the invention, and should not be held to be limiting in any capacity.

In step 506, digital logic detects that the predetermined value is present in the power cycling control register, and the corresponding digital logic associated with the power cycling process is executed. In one embodiment, the digital logic is realized by a field programmable gate array (FPGA) which controls various operational aspects of the wagering gaming machine.

In step 508, digital logic terminates voltage supplied to a controller (e.g., controller 440) or some other power supply which is currently distributing voltage to various central processing unit board (e.g., baseboard 410) components (e.g., CPU 411/412 and/or memory/storage devices 415/417/418), or signals one or more controllers to deactivate and stop distribution of voltage to its associated components. After voltage supplied to the controller stops (or the controller becomes deactivated), a predetermined time delay occurs as a capacitor (e.g., capacitor 445) drains electric charge (primarily) through a first resistor (e.g., $R_{DOWN}$) (step 510), continuing to supply voltage to the controller until the supplied voltage drops beneath a predetermined level, thereby deactivating the controller and stopping voltage from being delivered to the board components (step 512). In one embodiment, the draining of the capacitor causes a determinable time delay dependent upon the capacity of the capacitor and resistance of the circuitry coupling the capacitor to ground.

Once the capacitor drains through the first resistor, the controller is deactivated, and no voltage is being delivered to the components, another slight delay occurs (i.e., the time it takes to change state of the voltage path to the controller), immediately prior to reinstating voltage to the controller to resume voltage distribution (step 514). When voltage is reapplied to the controller, the recharging of the capacitor begins, which causes another given period of delay, again dependent upon the electric charge capacity of the capacitor and resistance of a second capacitor in the circuitry coupling the capacitor to the voltage source (step 516). Upon the capacitor becoming fully charged, sufficient voltage to the controller is restored for voltage distribution by the controller (step 518), for example, by activating an on board power controller when a predetermined voltage level is exceeded on a RUN pin of the power controller.

Returning power by supplying voltage to the central processing unit baseboard component(s) causes them to reinitialize as they are powered up (step 520). This power cycling and reboot process reinitializes the associated baseboard components, returning the onboard components to a default state, identical to a state the components would be in if the entire machine had been physically powered down and reactivated (via, for example, severed and restored wiring harness, main power switch on and off, or plug removal and reinsertion). This power cycling process allows the central processing unit baseboard, associated central processing unit(s), and other baseboard components to "cold boot" without impacting power supply to other components of the system including peripherals. The operation of other components and peripherals is not affecting because they generally have power source or voltage connections and/or power/voltage controllers which are completely independent from the central processing unit baseboard and its dedicated power controller. Further, there is no requirement for a user or operator to be physically engaged with the gaming machine to cause or complete any portion of the power cycling process.

The power cycling process returns to routine execution of the operating system (step 522/502) when the power cycling/reboot/re-initialization is complete, and the process repeats when the operating system or other software process again writes a predetermined value in the power cycle control register, and this is resultantly detected.

Figure 6:
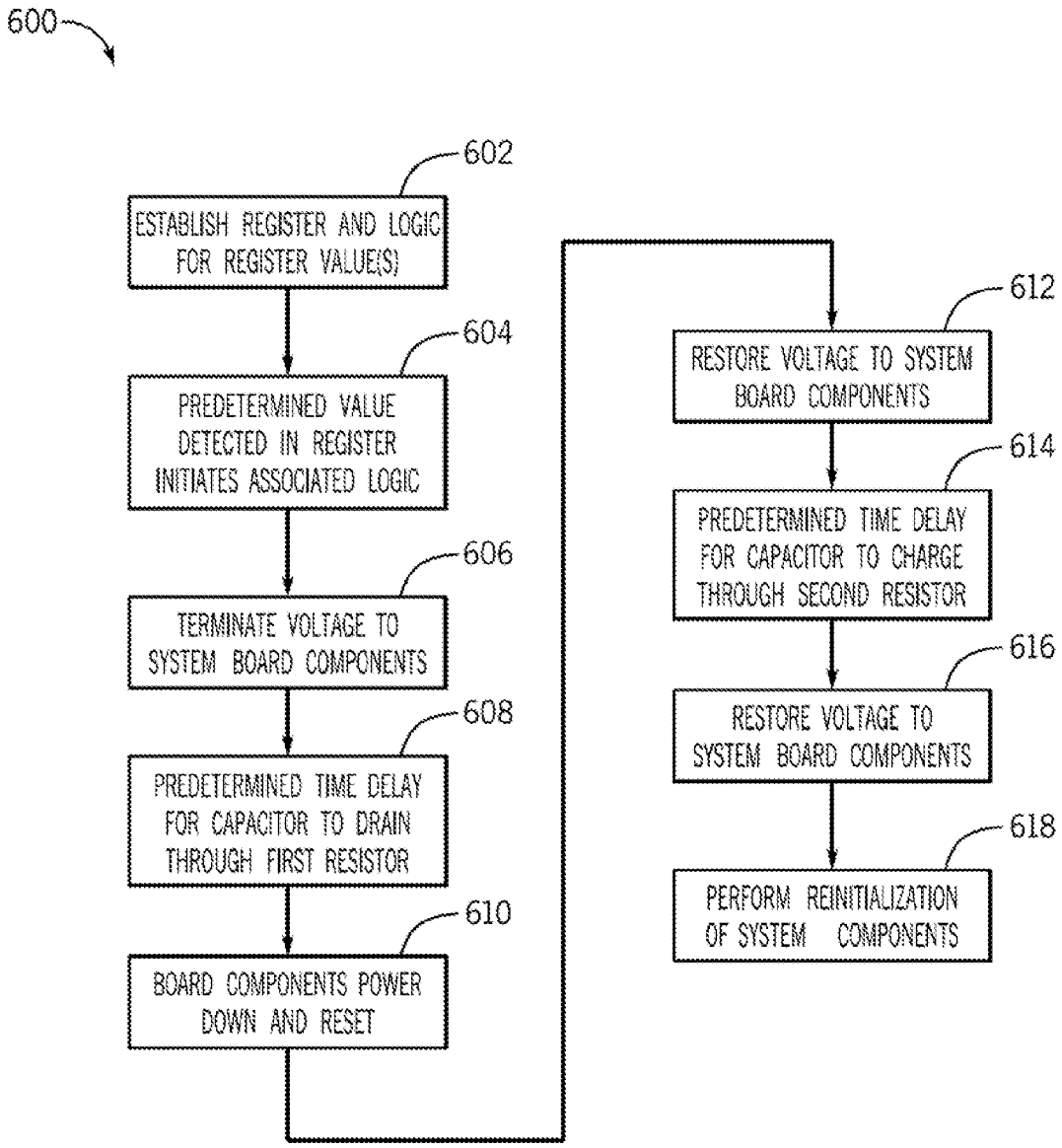
FIG. 6 is a flowchart for an algorithm for power cycling a set of one or more central processing unit board components on a central processing unit board according to an embodiment of the present invention.

FIG. 6 shows a flowchart for an algorithm for power cycling at least one central processing unit system component according to another embodiment of the present invention. Process 600 begins by establishing a register (e.g., PCCR 460) dictating that an associated set of computer executed digital logic instructions are performed, the instructions based upon the contents of the register (step 602). The contents of the register may be established via software (e.g., operating system alteration of register contents), or suitable hardware component(s) (e.g., a dedicated processor writing values into the register based upon system parameters or conditions).

In step 604, a predetermined value is detected in the register which causes the associated computer executed digital instructions cause the gaming machine to power cycle one or more central processing unit system components of the gaming machine.

In step 606, voltage being directed to the system board component(s) which are being power cycled is terminated. This may include specific individual components on the system board (e.g., CPU or communication interface), or a set of components controlled by a single source (e.g., a controller or power supply). Further, a single controller may control the entirety of voltage being supplied to the board as a whole, effectively "pulling the plug" on the entirety of the physical central processing box/board, including itself if it is also mounted on the affected board.

When voltage is turned off, a first capacitor (part of a resistor-capacitor circuit) causes a specifically timed delay dependent upon the electric charge capacity of the capacitor and resistance of circuitry coupling the capacitor to the voltage source (and ground) (step 608). Once the capacitor is fully drained, termination of voltage to the components of the gaming machine being power cycled drops below a minimum level to enable functionality by the component(s) (step 610). In one embodiment, this is achieved by activating a shutdown/shutoff mechanism for an on board power controller or power supply. During this time without voltage, the affected board components being power cycled are entirely powered down, and reset fully as a result.

After this delay and the powering down of the components of the controller, voltage is restored to the system board and the system board components (step 612), typically after an additional minimal delay. When voltage is supplied to the system board and the system board components (for instance, via a controller), the capacitor begins to charge and there is an associated delay (step 614). The duration of this delay is again due to the capacity of the capacitor and accompanying resistors, including a second resistor. In one embodiment, this delay is roughly 1.5 seconds, and may only be altered by use of a differently configured resistor-capacitor circuit, i.e., a differently resistant second resistor. Once the capacitor is fully charged, voltage is restored to the central processing unit board and system component(s) (step 616) at expected operating levels via the power controller. In one embodiment, this may occur, for example, by achieving a given operating voltage level to the RUN pin of an on board power controller, and the power controller supplies suitable voltage to the connected central processing unit system component(s). The central processing unit system component(s) which have completed the power cycling now reinitialize to a known, default state as a result of the reboot (step 618).

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A wagering game machine, comprising:

a central processing unit board including:

one or more central processing board components including at least one central processing unit configured to conduct a wagering game, receive wagers, and randomly determine outcomes of the wagering game;

a power controller coupled with and providing voltage to the one or more central processing board components;

a power cycle control register dedicated for initiating a power cycle control function when a predetermined value is stored within; and a power cycle circuit coupled to the power cycle control register and the power controller, the power cycle circuit including a resistor/capacitor circuit causing a delay before at least one of terminating or restoring voltage supplied by the power controller;

wherein, in response to detection of the predetermined value in the power cycle control register, the power cycle circuit performs the power cycle control function by terminating voltage supplied by the power controller and then restoring the voltage supplied by the power controller.

2. The wagering game machine of claim 1, wherein the resistor/capacitor circuit comprises a capacitor and a first resistor, the delay including a first delay proportional to a resistance of the first resistor and a discharge time of the capacitor before terminating the voltage supplied by the power controller.

3. The wagering game machine of claim 2, wherein the resistor/capacitor circuit further comprises a second resistor, wherein the delay includes a second delay proportional to a resistance of the second resistor and a charging time of the capacitor before restoring the voltage supplied by the power controller.

4. The wagering game machine of claim 3, wherein the second delay is larger than the first delay.

5. The wagering game machine of claim 1, wherein the power cycle circuit includes the power controller.

6. The wagering game machine of claim 5, wherein the resistor/capacitor circuit causes a first delay proportional to a resistance of a first resistor and a charging time of a capacitor, and causes a second delay proportional to a resistance of a second resistor and the charging time of the capacitor.

7. The wagering game machine of claim 1, wherein the one or more central processing board components include a hard disk drive (HDD) or solid state drive (SSD).

8. The wagering game machine of claim 1, wherein the one or more central processing unit board components include powered components directly coupled to the central processing unit board.

9. The wagering game machine of claim 1, wherein the power cycle circuit includes the power cycle control register.

10. The wagering game machine of claim 9, wherein the power cycle circuit includes at least one of a field programmable gate array (FPGA), an application specific integrated circuit (ASIC), transistor-transistor logic (TTL), resistor-transistor logic (RTL), or diode-transistor logic (DTL).

11. The wagering game machine of claim 1, wherein the power cycle circuit includes non-volatile memory containing instructions executed by the at least one central processing unit to perform functionality of the power cycle circuit.

12. A method for selectively initiating a power cycle control function of one or more central processing unit components coupled to a power controller of a board of a wagering gaming machine, the method comprising:

writing a value to a power cycle control register dedicated for initiating the power cycle control function of the one or more central processing unit components when a predetermined value is stored within;

wherein, a power cycle circuit including a resistor/capacitor circuit causes a delay before at least one of terminating or restoring voltage supplied by the power controller; and wherein, upon detection that the predetermined value is stored within the power cycle control register, the power controller performs the power cycle control function by terminating voltage supplied by the power controller and then restoring the voltage supplied by the power controller.

13. The method of claim 12, wherein the delay is proportional to a discharge time of a capacitor and occurs before terminating the voltage supplied by the power controller.

14. The method of claim 12, wherein the delay occurs before restoring the voltage supplied by the power controller, as a result of and proportional to a charging time of a capacitor.

15. The method of claim 12, wherein the one or more central processing unit components include a hard disk drive (HDD) or a solid state drive (SSD).

16. The method of claim 12, wherein the one or more central processing unit components include one or more central processing units.

17. The method of claim 12, wherein the one or more central processing unit components includes powered components coupled to the board of a wagering gaming machine.

18. A method for selectively initiating a power cycle control function of all powered components coupled to a board of a wagering gaming machine, the method comprising:

writing a value to a power cycle control register dedicated for initiating the power cycle control function of the all powered components coupled to the board of the wagering gaming machine when a predetermined value is stored therein;

wherein, a power cycle circuit including a resistor/capacitor circuit causes a delay before at least one of terminating or restoring voltage supplied by the power controller;

wherein, upon detection that the predetermined value is stored within the power cycle control register, the power cycle control function is performed by terminating voltage supplied by a power controller to the all powered components coupled to the board of the wagering game machine and then restoring the voltage supplied by the power controller to the all powered components coupled to the board of the wagering game machine.

19. The method of claim 18, wherein the delay occurs before terminating the voltage supplied to the all powered components coupled to the board of the wagering gaming machine, the delay proportional to a discharge time of a capacitor included in the resister/capacitor circuit.

20. The method of claim 18, wherein the delay occurs before restoring the voltage supplied to the all powered components coupled to the board of the wagering gaming machine, the delay proportional to a charging time of a capacitor included in the resister/capacitor circuit.

* * * * *